US010105581B2

(12) United States Patent
Abe et al.

(10) Patent No.: US 10,105,581 B2
(45) Date of Patent: Oct. 23, 2018

(54) GOLF CLUB HEAD

(71) Applicant: Dunlop Sports Co. Ltd., Kobe-shi, Hyogo (JP)

(72) Inventors: Hiroshi Abe, Kobe (JP); Yoshinori Sano, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/606,300

(22) Filed: May 26, 2017

(65) Prior Publication Data

US 2018/0001157 A1 Jan. 4, 2018

(30) Foreign Application Priority Data

Jun. 30, 2016 (JP) ..... 2016-130586

(51) Int. Cl.
*A63B 53/04* (2015.01)
*A63B 53/06* (2015.01)
*A63B 60/50* (2015.01)

(52) U.S. Cl.
CPC ..... *A63B 53/047* (2013.01); *A63B 60/50* (2015.10); *A63B 53/04* (2013.01); *A63B 2053/042* (2013.01); *A63B 2053/0408* (2013.01); *A63B 2053/0433* (2013.01); *A63B 2053/0491* (2013.01)

(58) Field of Classification Search
CPC ..... A63B 53/047; A63B 60/50; A63B 2053/0408; A63B 2053/042; A63B 2053/0433; A63B 53/04; A63B 2053/0491
USPC ..... 473/324–350, 287–292, 313–314, 473/244–248
See application file for complete search history.

(56) References Cited

U.S. PATENT DOCUMENTS 5,190,290 A * 3/1993 Take ..... A63B 53/04 273/DIG. 23
5,386,996 A * 2/1995 Hiruta ..... A63B 53/04 473/346
5,439,223 A * 8/1995 Kobayashi ..... A63B 53/04 473/334
6,616,546 B2 * 9/2003 Cho ..... A63B 53/04 473/329
6,638,183 B2 * 10/2003 Takeda ..... A63B 53/047 473/335

(Continued)

FOREIGN PATENT DOCUMENTS

JP 10-295861 A 11/1998

*Primary Examiner* — Sebastiano Passaniti
(74) *Attorney, Agent, or Firm* — Birch, Stewart, Kolasch & Birch, LLP

(57) ABSTRACT

A golf club head comprises a head main body 10, a weight member 20 and a fixing member 30. The head main body 10 is provided with a convex portion 19 protruding toward the outside of the head. The weight member 20 is provided with a through hole 22, and disposed outside the head main body so that the convex portion is positioned in the through hole. The fixing member 30 is welded to the head main body in a state in which the fixing member covers at least a part of the weight member from the outer side of the head. A securing portion 50 for fixing the weight member to the head main body is formed between the through hole and the convex portion.

10 Claims, 14 Drawing Sheets

(56) References Cited

U.S. PATENT DOCUMENTS

| | | | | |
|---|---|---|---|---|
| 6,929,563 | B2 * | 8/2005 | Nishitani | A63B 53/047 473/334 |
| 8,740,722 | B2 * | 6/2014 | Sato | A63B 53/047 473/334 |
| 2013/0165251 | A1 * | 6/2013 | Jorgensen | A63B 53/06 473/328 |

* cited by examiner

GOLF CLUB HEAD

TECHNICAL FIELD

The present invention relates to a golf club head comprising a head main body and a weight member, more particularly to a golf club head capable of suppressing the generation of noise caused by vibrations of the weight member thereof.

BACKGROUND ART

Japanese Patent Application Publication No. JP-H10-295861 (Patent Document 1) discloses a golf club head, wherein the head main body is formed from a light metal, and weight members having a larger specific gravity than the light metal are embedded in the head main body on the lower side of a back cavity of the head.

SUMMARY OF THE INVENTION

Problems to be Solved by the Invention

In a golf club head provided with weight members as disclosed in Patent Document 1, there is a possibility that, by striking a ball, the weight members are vibrated, and sometimes a problem of abnormal noise arises.

It is therefore, an object of the present invention to provide a golf club head in which, although a separate weight member is attached to the head main body, generation of abnormal noise due to the weight member is effectively suppressed.

According to the present invention, a golf club head comprises:

a head main body provided with a convex portion protruding toward the outside of the head, a weight member provided with a through hole, and disposed outside the head main body so that the convex portion is positioned in the through hole, and a fixing member welded to the head main body in a state in which the fixing member covers at least a part of the weight member from the outer side of the head, wherein a securing portion for fixing the weight member to the head main body is formed between the through hole and the convex portion.

Therefore, in the golf club head according to the present invention, even if the weight member is not welded to the head main body, the generation of abnormal noise caused by the weight member can be effectively suppressed.

Further, the golf club head according to the present invention may have the following features (1)-(10):

(1) the securing portion is a weld bead united with the convex portion;

(2) the through hole has an inside opening and an outside opening on the head main body side and on the outer side of the head, respectively, and a cross-sectional area of the through hole is larger at the outside opening than at the inside opening;

(3) the through hole has an inside opening and an outside opening on the head main body side and on the outer side of the head, respectively, and the through hole have a tapered portion whose cross-sectional area is gradually decreased from the outside opening toward the head main body;

(4) the convex portion is provided in its tip end side with a tapered part;

(5) the through holes is formed in a central portion in the longitudinal direction of the weight member;

(6) the specific gravity of the weight member is greater than the specific gravity of the fixing member which is greater than the specific gravity of the head main body;

(7) weldability between the head main body and the fixing member is superior to weldability between the head main body and the weight member;

(8) the head main body is provided with a recess, which is recessed from the outer surface of the head having a finished shape, and in which the weight member is disposed;

(9) the weight member is disposed in the recess without being exposed in the outer surface of the head which surface has the finished shape, a surface of the weight member facing toward the outside of the head is provided in an edge portion thereof with a first stepped portion, and the first stepped portion is covered with a weld bead united with the convex portion;

(10) the weight member is disposed in the recess without being exposed in the outer surface of the head which surface has the finished shape, a surface of the weight member facing toward the outside of the head is provided in an edge portion thereof with a second stepped portion, and the second stepped portion is covered with a part of a weld bead which welds the head main body and the fixing member together;

DESCRIPTION OF THE PREFERRED EMBODIMENTS

The present invention can be applied to various golf club heads such as iron type golf club heads, wood type golf club heads, utility type golf club heads and putter type golf club heads.

Hereinafter, taking an iron type golf club head as an example, embodiments of the present invention will now be described in detail with reference to the accompanying drawings.

FIGS. 1-6 show an iron type golf club head 1 as an embodiment of the present invention.

Unless otherwise noted, the description will be made given that the golf club head 1 is in its standard state.

Figure 15:
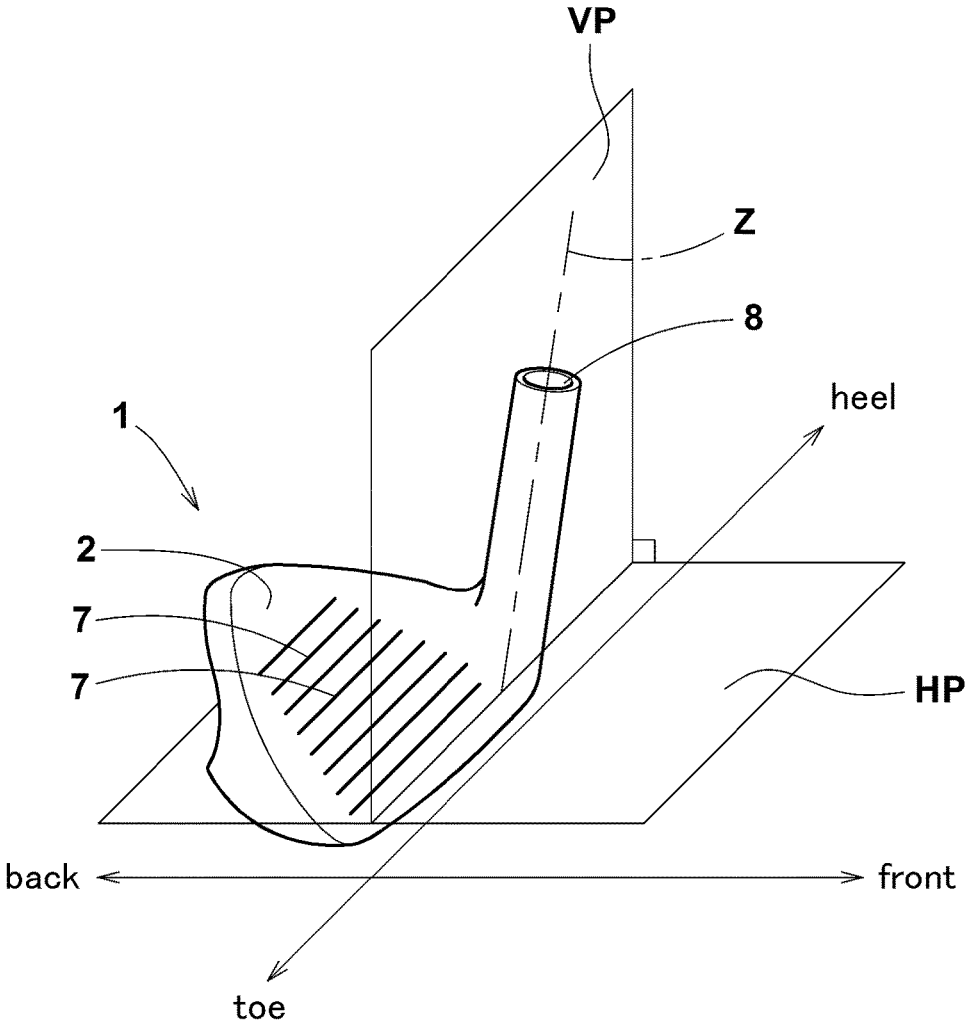
FIG. 15 is a schematic perspective view for explaining the standard state of a golf club head.

The "standard state" is, as shown in FIG. 15, a state of the golf club head 1 which is set on a horizontal plane HP such that the center line z of a shaft insertion hole 8 of the golf club head (corresponding to the club shaft center line) is positioned in a vertical plane VP perpendicular to the horizontal plane HP, and score lines 7 formed in a face 2 become in parallel with the horizontal plane HP, and in parallel with the vertical plane VP.

The term "up-down direction" means a direction perpendicular to the horizontal plane HP.

The term "toe-heel direction" means a direction in parallel with the horizontal plane HP and in parallel with the vertical plane VP.

The term "front-back direction" means a direction in parallel with the horizontal plane HP and perpendicular to the vertical plane VP.

Figure 14:
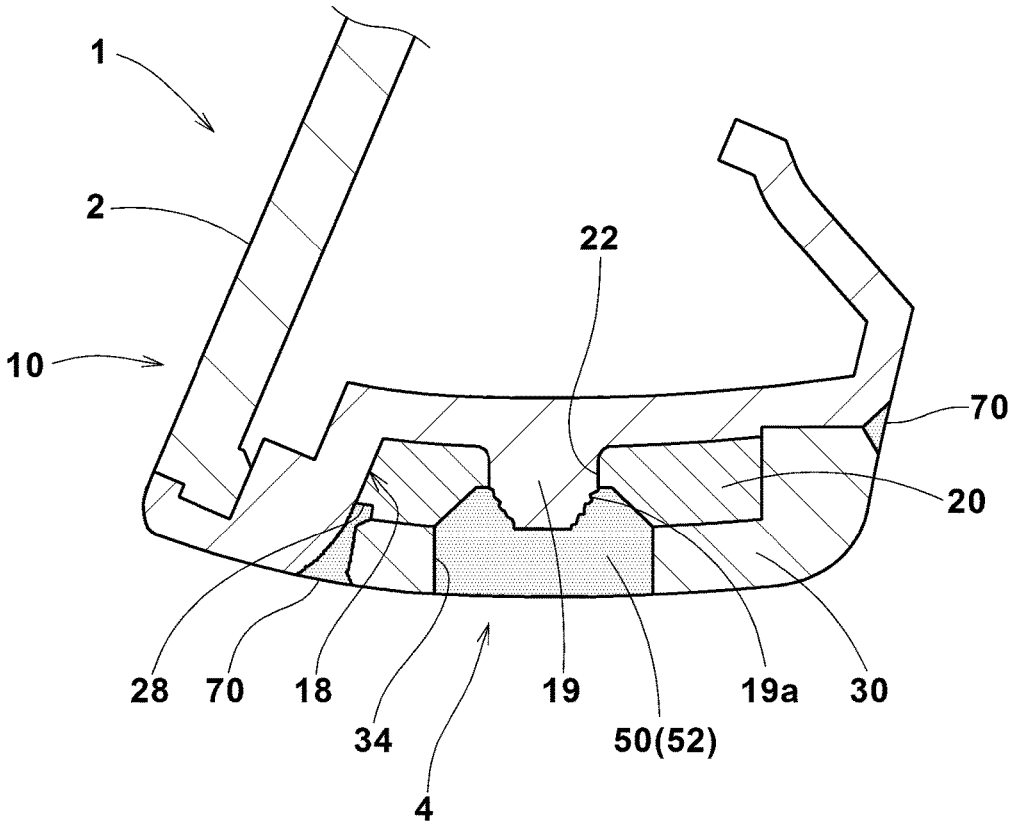
FIG. 14 is a cross-sectional partial view of a golf club head as another embodiment of the present invention taken along a line corresponds to line B-B of FIG. 2.

Incidentally, as shown in FIG. 14, "front" of the golf club head 1 means a side of the face 2 which strikes a golf ball, and "rear" means the opposite side thereto. In view of the custom of the golf industry, "rear" and "rear side" of the golf club head may be referred to as "back" and "back side", respectively. Further, "up" with regard to the golf club head 1 is defined as a direction away from the horizontal plane HP or a position distant from the horizontal plane HP, relatively. On the other hand, "low" with regard to the golf club head 1 is defined as a direction closer to the horizontal plane HP or a position closer to the horizontal plane HP, relatively. In view of the custom of the golf industry, a "lower surface" of the golf club head may be referred to as a "bottom surface".

Further, the expression "forward tilted state" used hereinafter means a state of the golf club head 1 in which the golf club head 1 in the standard state is tilted forward around a horizontal axis extending in parallel with both the horizontal plane HP and the standard vertical plane VP so that the face 2 becomes in parallel with the vertical plane VP.

As shown in FIGS. 1-6, the golf club head 1 in this embodiment has a shape typical of the iron-type, and comprises a face 2, a top 3, a sole 4, a toe 5 and a hosel 6.

Figure 1:
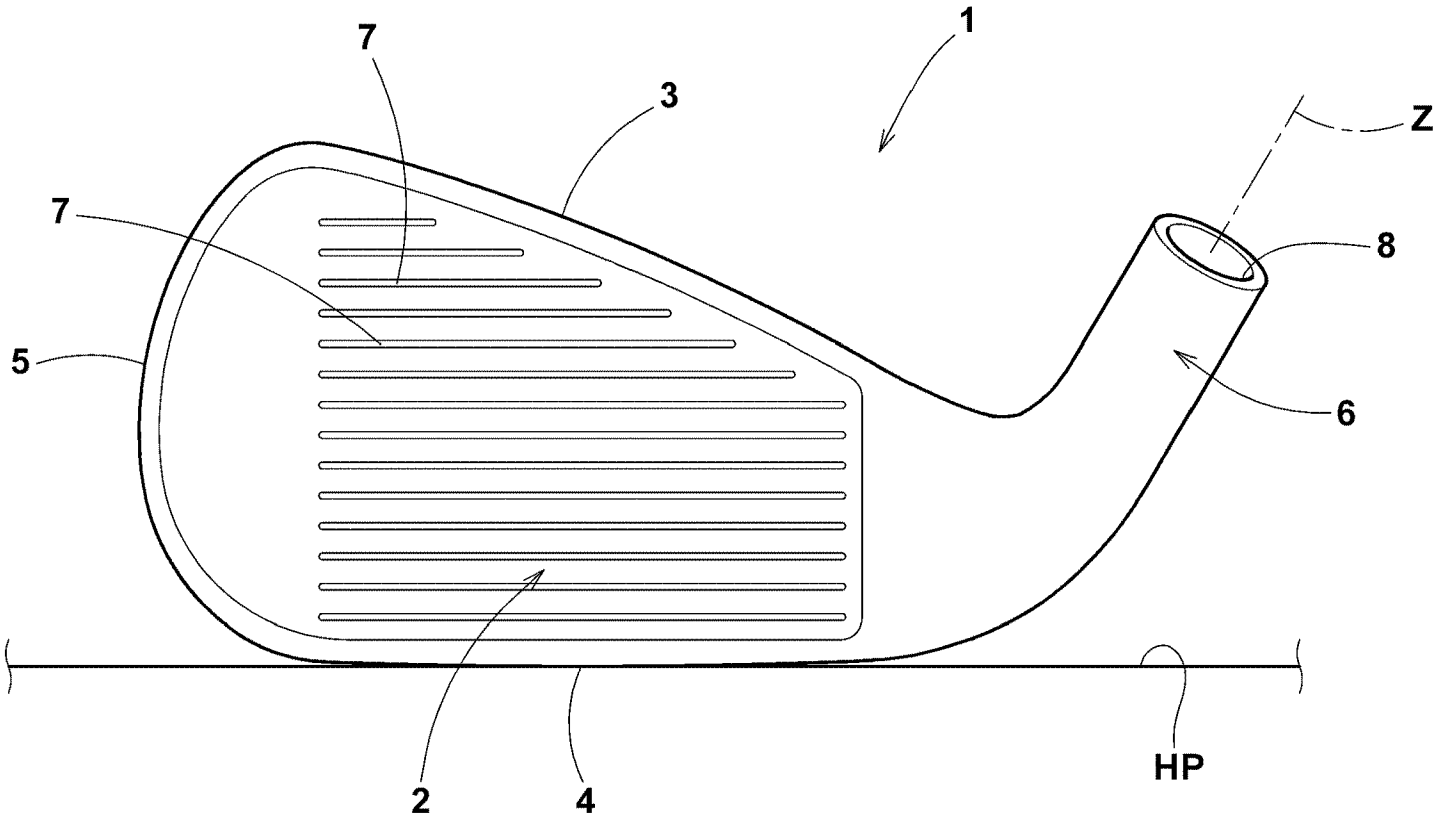
FIG. 1 is a front view of a golf club head as an embodiment of the present invention.
Figure 2:
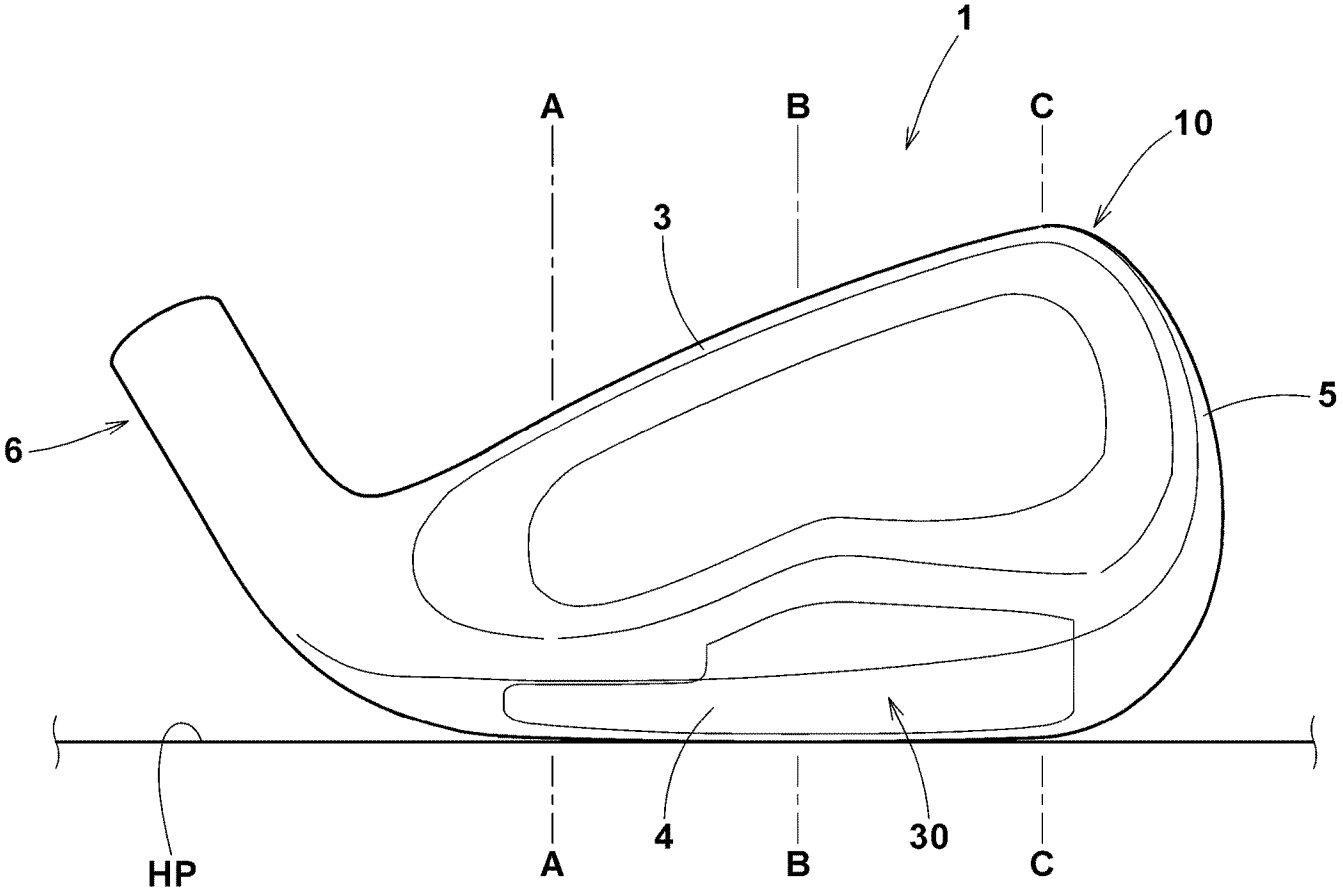
FIG. 2 is a rear view the golf club head.

FIGS. 1 and 2 show the front view and rear view of the head 1 in the forward tilted state.

Figure 3:
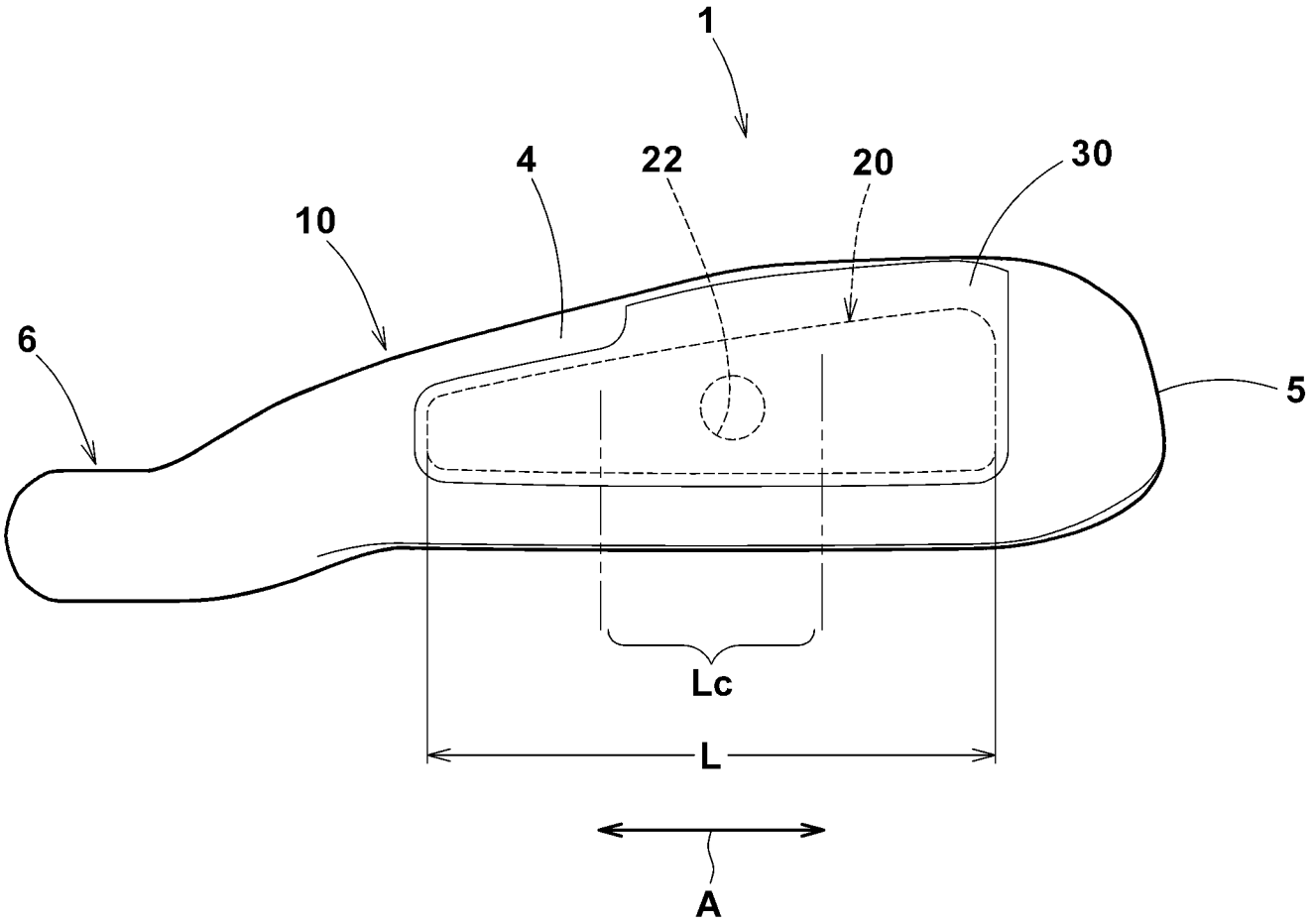
FIG. 3 is a bottom view of the golf club head.
Figure 4C:
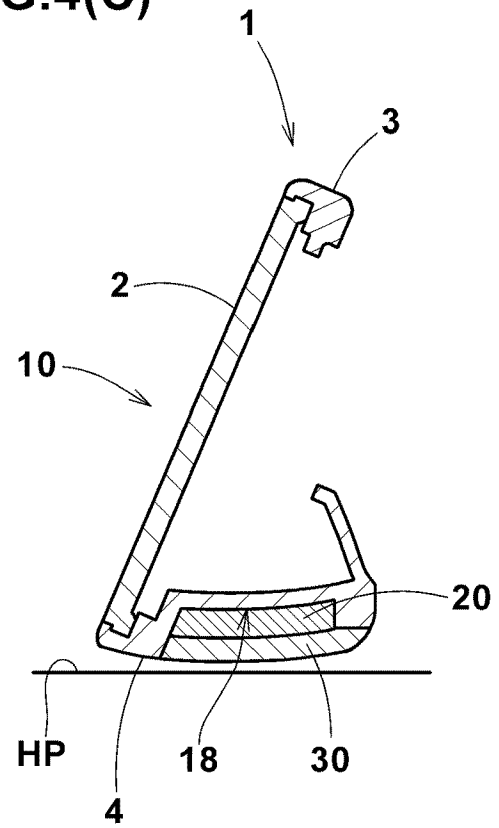
FIGS. 4(A), 4(B) and 4(*c*) are schematic cross-sectional views of the golf club head under its standard state taken along line A-A, line B-B and line c-c of FIG. 2, respectively.
Figure 4B:
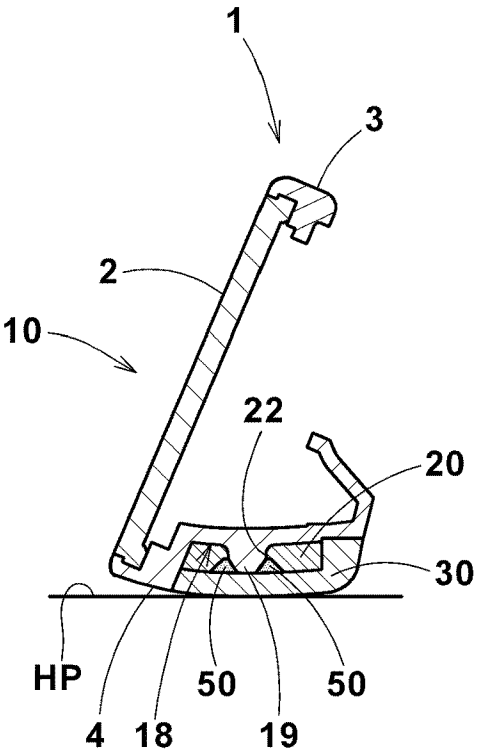
Figure 4A:
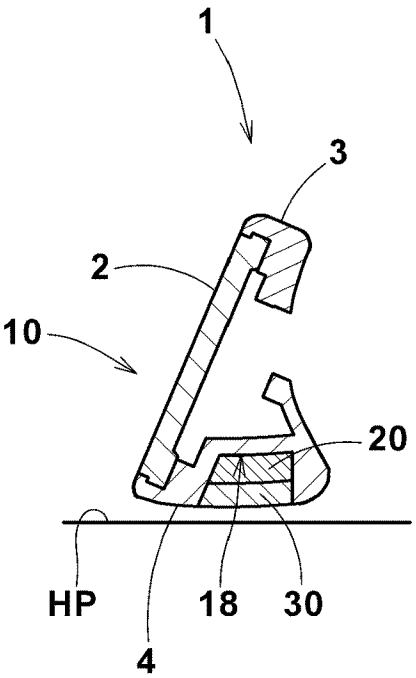

FIGS. 3 and 4(A)-4(*c*) show the bottom view and cross-sectional views of the head 1 in the standard state.

The face 2 is a substantially flat face for striking a golf ball. The face 2 is provided with the above-mentioned score lines 7 in order to increase friction on the golf ball surface.

The top 3 is an upper surface portion of the golf club head 1 extending backward from an upper edge of the face 2.

The sole 4 is a bottom surface portion of the golf club head 1 extending backward from a lower edge of the face 2.

The toe 5 is a portion located most distant from the hosel 6 and connecting smoothly between the top 3 and the sole 4.

The hosel 6 is a part provided with a shaft insertion hole 8 into which a tip end of a golf club shaft (not shown) is attached, and formed as a tubular upwardly protruding part for example. Incidentally, the center line z of the shaft insertion hole 8 substantially coincides with the center line of the golf club shaft.

Figure 5:
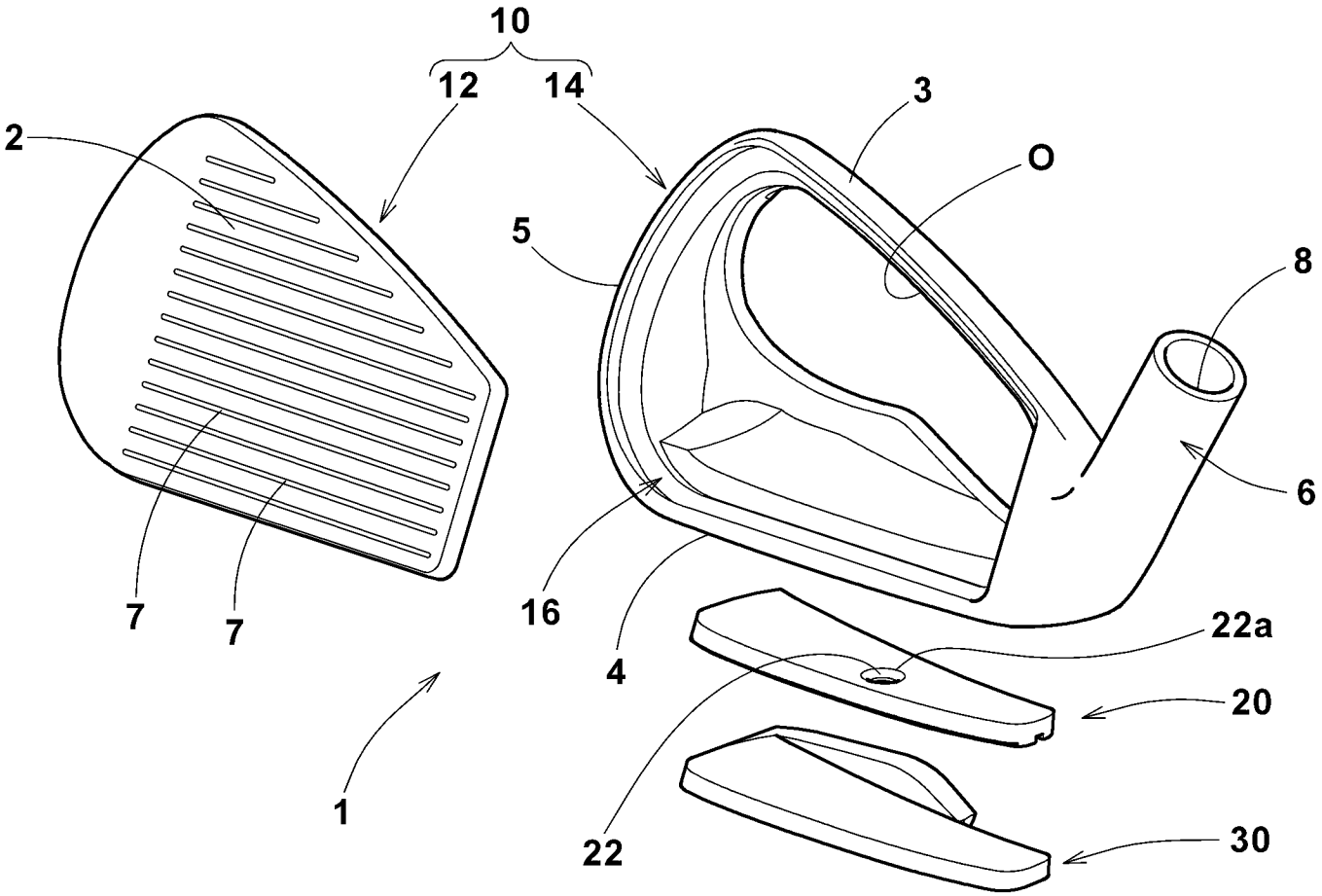
FIG. 5 is an exploded perspective view of the golf club head viewed diagonally from the front.
Figure 6:
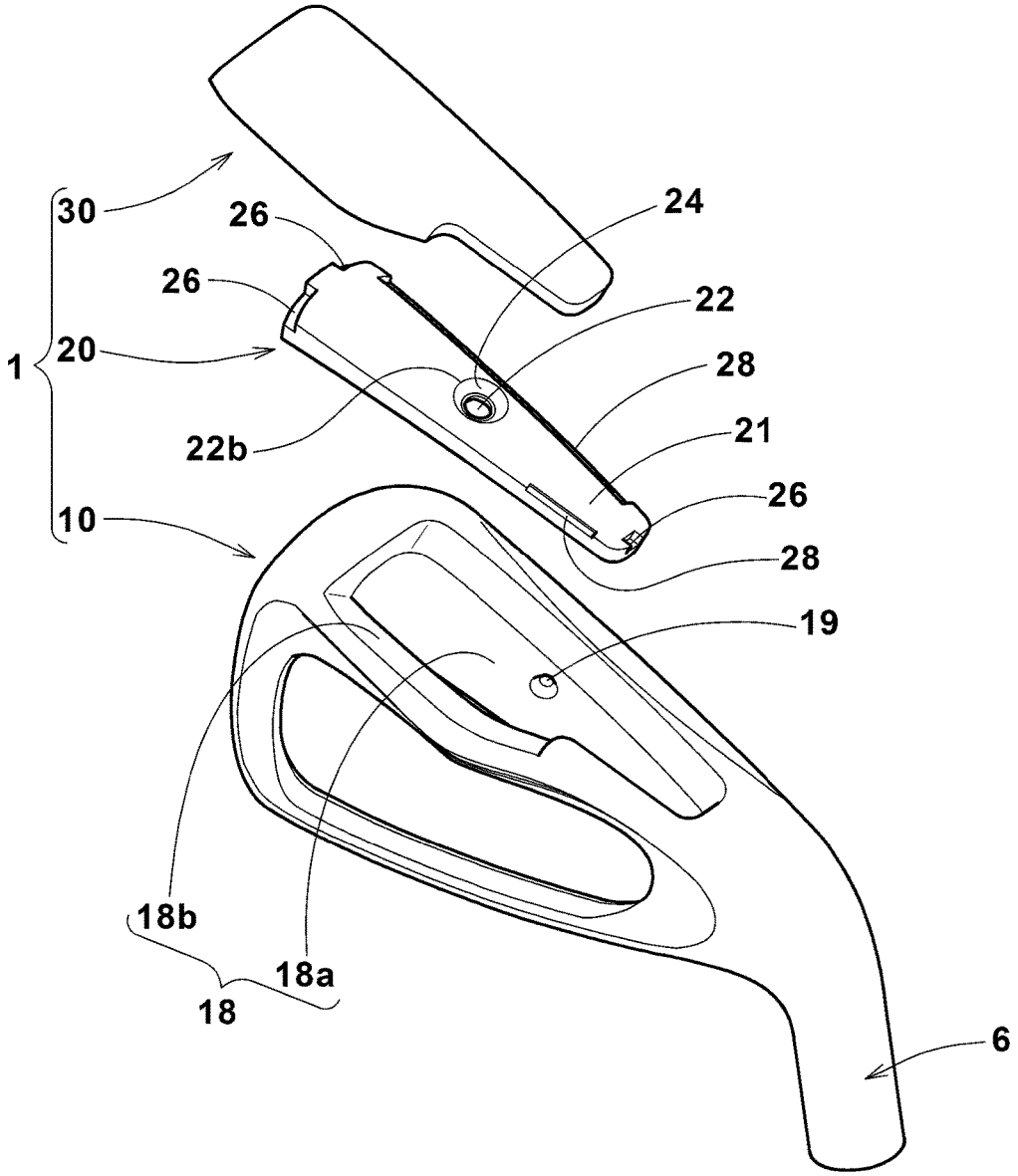
FIG. 6 is an exploded perspective view of the golf club head viewed diagonally from the under side.

The golf club head 1 in this embodiment is composed of a head main body 10, a weight member 20 and a fixing member 30 as shown in FIGS. 4 to 6.

The head main body 10 constitutes a major part of the golf club head 1, and in this embodiment, it includes the face 2, the top 3, the sole 4, the toe 5 and the hosel 6.

The head main body 10 is made of a metal material or metal materials for example.

Preferably, the head main body 10 includes a face plate 12 and a face plate receiving part 14 as shown in FIG. 5.

In this embodiment, the face plate 12 and the face plate receiving part 14 are made of different metal materials.

The metal material of the face plate 12 has the smallest specific gravity among the metal materials of the golf club head 1.

The face plate 12 is preferably made of a titanium alloy with a high specific strength whose specific gravity is not more than 4.5 in order to shift the position of the center of gravity of the head more downward and backward.

The face plate receiving part 14 is provided with a through hole surrounded by the top 3, the sole 4 and the toe 5 and having a front opening O.

The face plate receiving part 14 is provided around the front opening O with a face mounting part 16 to which a peripheral part of the face plate 12 is fixed.

The front opening O is closed by the face plate 12 fixed to the face mounting part 16.

In order to fix the face plate 12 to the face plate receiving part 14, various techniques, for example, welding, brazing, soldering, adhesive bonding, caulking, press fitting etc. can be used alone or in combination.

The above-mentioned hosel 6 is formed integrally with the face plate receiving part 14.

The face plate receiving part 14 is preferably made of an iron-based alloy with a basic strength and good processability such as stainless steel and carbon steel. Specifically, iron-based alloys having a specific gravity of more than 7.0, preferably more than 7.5 can be preferably used. As described above, when the face plate receiving part 14 is made of the metal material whose specific gravity is greater than the face plate 12, the center of gravity of the head can be positioned more downward and backward.

Further, it is also possible to form the head main body 10 from a single material or three or more different materials. When the head main body 10 is formed from a single material, a typical example of the head main body 10 is such that the face plate 12 and the face plate receiving part 14 are integrally formed as one piece through a technique, e.g. machining, casting, lasering and the like. Another example of the head main body 10 is one having a multi-piece structure in which the face plate 12 and the face plate receiving part 14 which are made of the same material are integrally fixed to each other.

A typical example of the head main body 10 formed from three or more different materials is one having a multi-piece structure in which the face plate 12 is integrally fixed to the face plate receiving part 14 composed of two or more parts made of different materials. In this case, the face plate 12 and the parts constituting the face plate receiving part 14 are made of three or more different materials.

The head main body 10 is provided with a recess 18 denting from the outer surface of the head having its finished shape as shown in FIGS. 4(*a*)-4(C) and 6.

In this embodiment, by disposing the weight member 20 and the fixing member 30 in the recess 18, the head is provided with the outer surface having the finished shape.

In other words, the recess 18 is defined as a part (void) formed by removing the weight member 20 and the fixing member 30 from the finished shape of the head.

Such golf club head 1 can provide the center of gravity being lowered.

It is desirable to form the recess 18 in a position other than the face 2. However, if a part of the face 2 is formed by the face plate 12, the recess 18 may be formed in a position other than the face plate 12.

The recess 18 in this embodiment is formed in a sole 4 side position of the face plate receiving part 14, more specifically, in the sole of the face plate receiving part 14, and the recess 18 elongates in the toe-heel direction.

As shown in FIG. 6, the recess 18 in this example is formed in the form of a groove extending in the sole 4 in the toe-heel direction (parallel with the direction of the score lines 7 shown in FIG. 15).

The recess 18 provides a recessed space defined by a bottom wall 18*a* and a surrounding wall 18*b* disposed so as to surround the bottom wall 18*a*.

In this embodiment, a toe side part of the recess 18 is extended to the back side of the head main body 10.

However, the recess 18 is not limited to such configuration. The recess 18 can be formed in any position other than the face 2. Further, the shape of the recess 18 may be variously changed.

Furthermore, the head main body 10 is provided with at least one convex portion 19 protruding toward the outside of the head. In this embodiment, only one convex portion 19 is formed in the recess 18, for example, on the bottom wall 18*a* of the recess 18. In this embodiment, the convex portion 19 is formed in a substantially cylindrical shape. But, the convex portion 19 is not limited to such shape. Further, the head main body 10 may be provided with two or more convex portions 19.

The weight member 20 in this embodiment is elongated in the toe-heel direction according to the recess 18 as shown in FIGS. 5 and 6. The weight member 20 in this embodiment has a shape such that the weight member 20 can fit in the recess 18. The weight member 20 contacts, at least in part, with the bottom wall 18*a* and the surrounding wall 18*b* of the recess 18. This prevents the weight member 20 from moving in the toe-heel direction, front-back direction and upward direction, and serves to suppress the generation of noise due to vibrations of the weight member 20.

The weight member 20 is made of a metal material having a specific gravity greater than those of the head main body 10 and the fixing member 30. Such weight member 20 may have a large effect on the position of the center of gravity of the head, and it is possible to shift the center of gravity of the head toward the center of gravity of the weight member 20. In this embodiment, it is possible to shift the center of gravity of the head toward the sole 4.

If the head main body 10 is made of one kind of material, the specific gravity of the head main body 10 can be obtained as the specific gravity of the material.

If the head main body 10 is composed of a plurality of parts having different specific gravity values, the specific gravity of the head main body 10 can be obtained as a weighted arithmetic average by averaging the specific gravity values of the parts which are respectively weighted by the volumes of the parts.

Preferably, the weight member 20 is made of a tungsten-nickel-iron alloy comprising W, Ni and Fe.

It is not essential but preferable that the specific gravity of the weight member 20 is set to be not less than 10.0, more preferably not less than 12.0. But, the specific gravity is preferably set to be not more than 18.5.

Such alloy can be increased in the specific gravity by increasing the content of the tungsten w relatively to the content of the iron Fe. However, due to the relatively decreased content of the iron, the alloy is decreased in the weldability to an iron based alloy such as soft iron and stainless steel.

According to the present invention, it is possible to use, as the weight member 20, the alloy whose specific gravity is greatly increased by increasing the content of the tungsten w such that the weight member 20 can not be welded to the head main body 10. Therefore, the alloy highly increased in the specific gravity is employed in this embodiment.

Figure 7A:
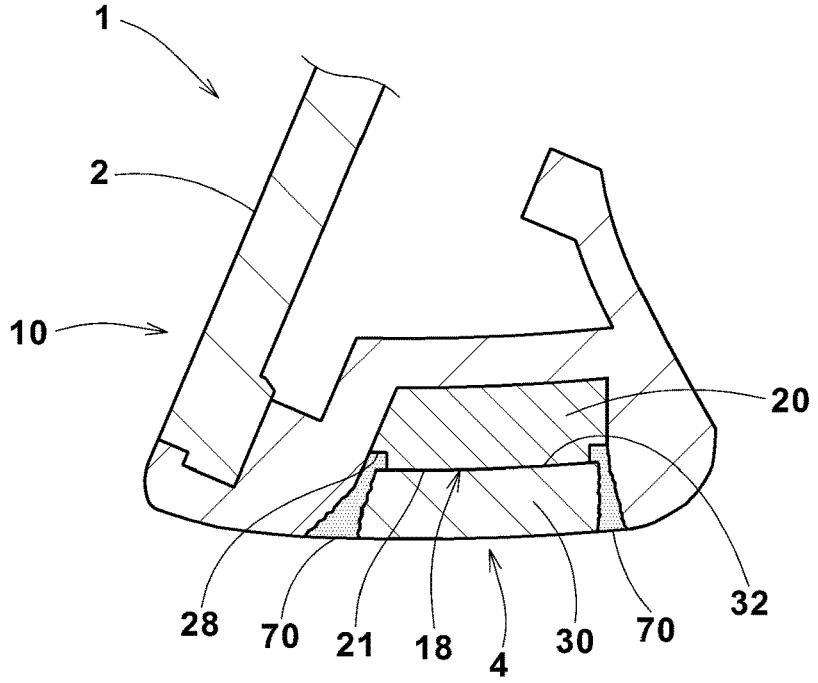
FIG. 7(A) is a closeup of FIG. 4(A).
Figure 7B:
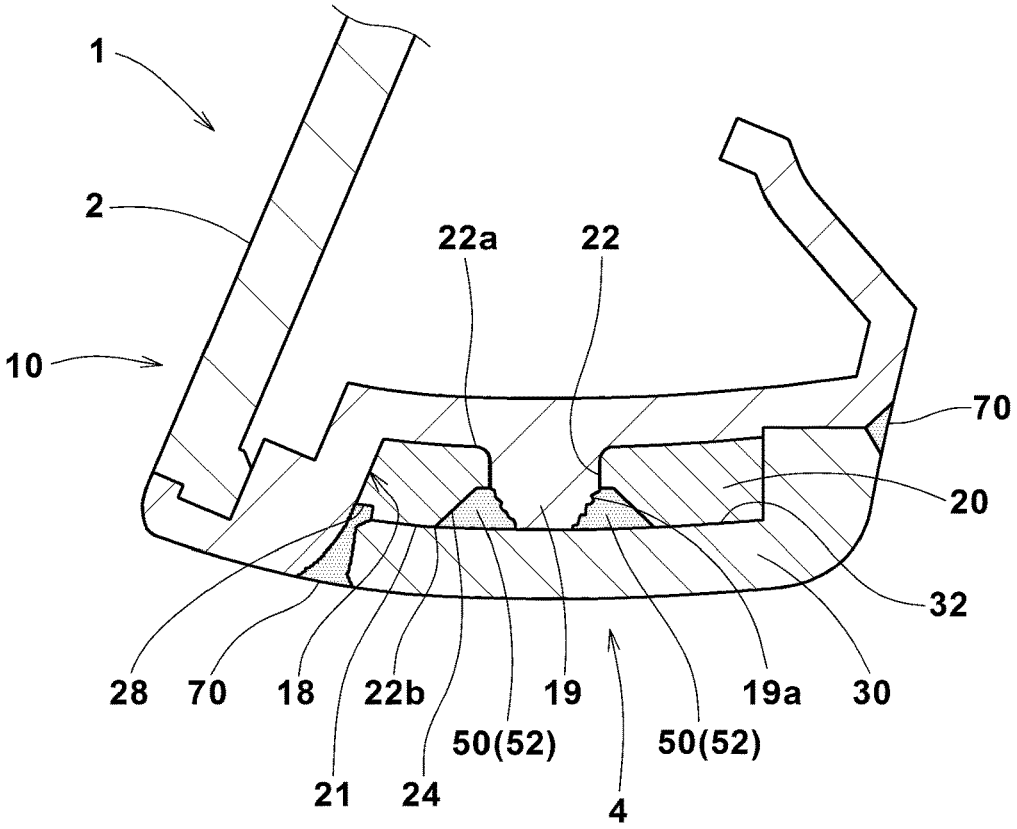
FIG. 7(B) is a closeup of FIG. 4(B).

According to the present invention, the weight member 20 is provided with a through hole 22 as shown in FIGS. 5, 6 and FIG. 7(B).

The weight member 20 is disposed on the outer side of the head main body 10 so that the convex portion 19 of the head main body 10 is positioned at the through hole 22.

In this embodiment, the weight member 20 is disposed in the recess 18 so that the convex portion 19 is positioned in the through hole 22. The weight member 20 contacts with the wall (18*a*, 18*b*) of the recess 18, and the through hole 22 is engaged with the convex portion 19. Thus, the vibrations of the weight member 20 relative to the head main body 10 can be further suppressed, and the generation of noise caused by the vibrations of the weight member 20 can be suppressed.

In this embodiment, the convex portion 19 is engaged with the through hole 22. But, it is also possible that the through hole 22 and the convex portion 19 are not engaged with each other, and a gap is formed between the inner surface of the through hole 22 and the outer surface of the convex portion 19.

The through hole 22 is preferably disposed in a center portion Lc in the longitudinal direction (A) of the weight member 20 as shown in FIG. 3. By forming the through hole 22 in such a position and restraining the weight member 20 with the convex portion 19 positioned in the through hole 22, vibrations of the weight member 20 can be more effectively suppressed. Here, the longitudinal direction (A) of the weight member 20 is a direction in which the maximum length L of the weight member 20 occurs, in this embodiment, which is the toe-heel direction. Further, the center portion Lc in the longitudinal direction is a portion extending from the center in the longitudinal direction of the maximum length L toward each side in the longitudinal direction by 20% of the maximum length L of the weight member 20.

The golf club head 1 in this embodiment is, as shown in FIG. 7(B), provided between the through hole 22 and the convex portion 19 with a securing portion 50 for fixing the weight member 20 to the head main body 10.

It is preferable that the securing portion 50 fills up the gap formed between the through hole 22 and the convex portion 19 so as to restrain their movements relative to each other by the friction or mechanical engagement therebetween. For example, a weld bead 52 welded or united to the convex portion 19 can be suitably used as the securing portion 50. Incidentally, the weld bead 52 is formed by solidifying a molten metal material. In this embodiment, the weld bead 52 is fused with a metal material forming the convex portion 19, namely, the metal material forming the head main body 10.

Before being solidified into the weld bead 52, the molten metal material penetrates into fine gaps between the through hole 22 and the convex portion 19, and then the metal material is solidified in a state filling up the gaps and unites with the convex portion 19. Thus, even if the securing portion 50 is not united with the weight member 20, as the securing portion 50 reduces the gap between the through hole 22 and the convex portion 19, it is possible to more effectively suppress vibrating motions of the weight member 20 relative to the head main body 10, i.e., vibrating motions in the protruding direction of the convex portion 19 and the perpendicular direction thereto.

In this embodiment, in order to enhance the effect of the securing portion 50 to restrain the weight member 20, a tapered portion 19*a* is formed in a tip end part of the convex portion 19 so that the gap increasing toward the outer surface of the head is formed between the tapered portion 19*a* and the inner surface of through hole 22.

Such gap can be utilized as a groove formed in advance of welding joint, and it is possible to fill it with an adequate amount of the molten metal material.

Preferably, the molten metal material is supplied to the gap or space as a filler metal which is separate from the metal material forming the convex portion 19. The filler metal is fused together with the surface of the convex portion 19 and become solidified and integrated. By the solidification of the molten metal, the securing portion 50 is formed around the outer peripheral portion of the convex portion 19 by the weld bead 52, and the contact with the through hole 22 is increased.

The through hole 22 has an inside opening 22*a* on the head main body 10 side and an outside opening 22*b* toward the outside of the head. Preferably, the cross-sectional area of the through hole 22 at the outside opening 22*b* is larger than that at the inside opening 22*a*.

In the example of the through hole 22 shown in FIGS. 5, 6 and FIG. 7(B), the through hole 22 comprises a tapered portion 24 of which cross-sectional area is gradually decreased from the outside opening 22*b* toward the head main body 10.

According to such configuration, the gap or space between the through hole 22 and the convex portion 19 can form the securing portion 50 which is gradually expanded toward the outside of the head.

The molten metal supplied to such gap reaches to a deeper position of the gap or to a base position of the convex portion, and the gap is filled with the molten metal. Further, the weld bead 52 formed in the gap can hold down the tapered portion 24 from the outer side of the head. Therefore, it is possible to mechanically restrain movements of the weight member 20 in the projecting direction of the convex portion, and thereby the generation of noise caused by the vibrations of the weight member 20 can be more reliably suppressed.

It is preferable that the tapered portion 24 of the through hole 22 is used together with the tapered portion 19*a* of the convex portion 19. But, the through hole 22 with the tapered portion 24 can be used together with the tapered part 19*a* without the convex portion 19.

Figure 8:
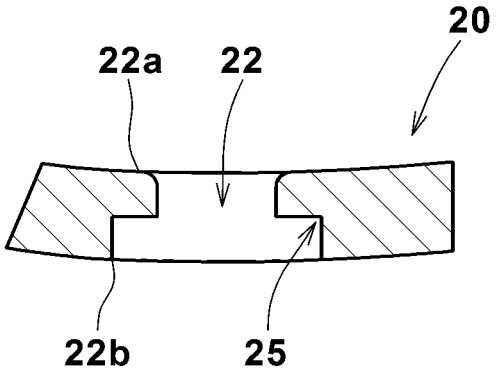
FIG. 8 is a cross-sectional view of another example of the through hole of the weight member.

FIG. 8 shows another example of the through hole 22 whose cross-sectional area is larger at the outside opening 22*b* than at the inside opening 22*a*. In this example, the cross-sectional area of the through hole 22 is increased stepwise, and the through hole 22 comprises an enlarged diameter portion 25 extending from the outside opening 22*b* toward the head main body 10 and having a larger diameter, and a resultant small diameter portion extending from the enlarged diameter portion 25 to the inside opening 22*a* and having a smaller diameter.

This configuration is preferably employed together with the convex portion 19 provided with the tapered portion 19*a*, but it is also possible to employ it together with the convex portion 19 without the tapered portion 19*a*.

Figure 9:
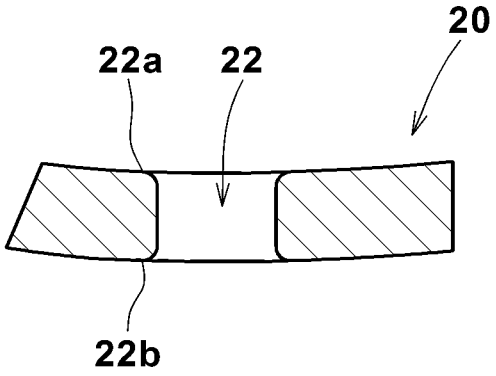
FIG. 9 is a cross-sectional view of still another example of the through hole of the weight member.

FIG. 9 shows still another example of the through hole 22 in which the cross-sectional area at the inside opening 22*a* is substantially the same as the cross-sectional area at the outside opening 22*b*.

Figure 10A:
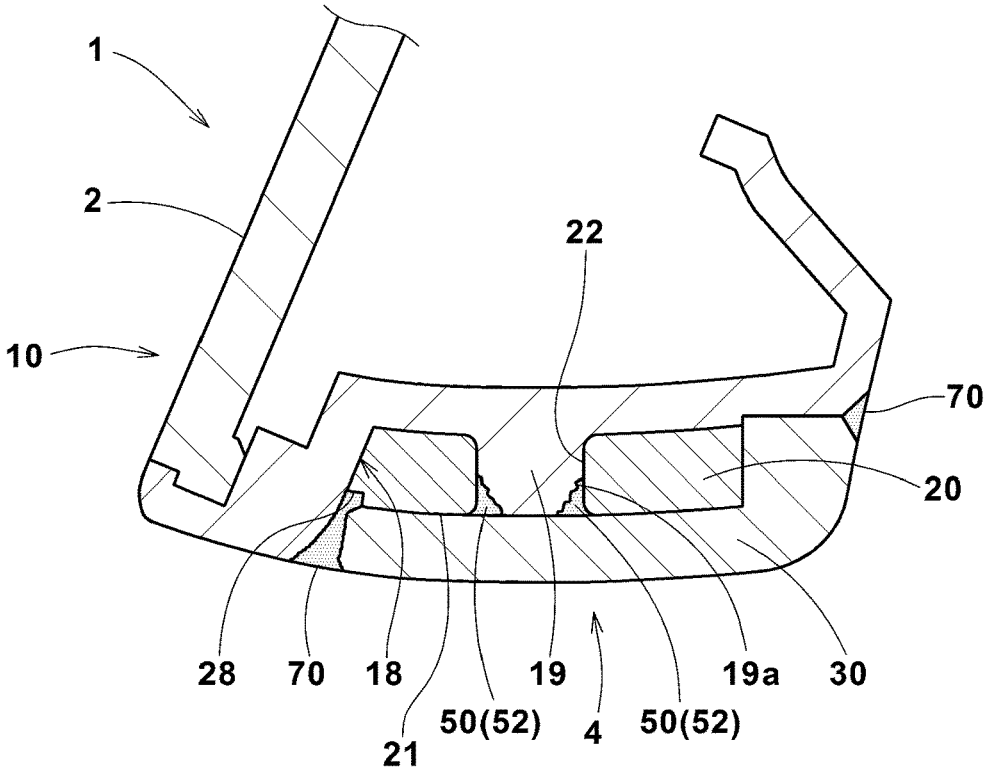
FIG. 10(A) is a cross-sectional partial view of a golf club head as another embodiment of the present invention in which the weight member shown in FIG. 9 is employed, taken along a line corresponding to line B-B of FIG. 2.
Figure 10B:
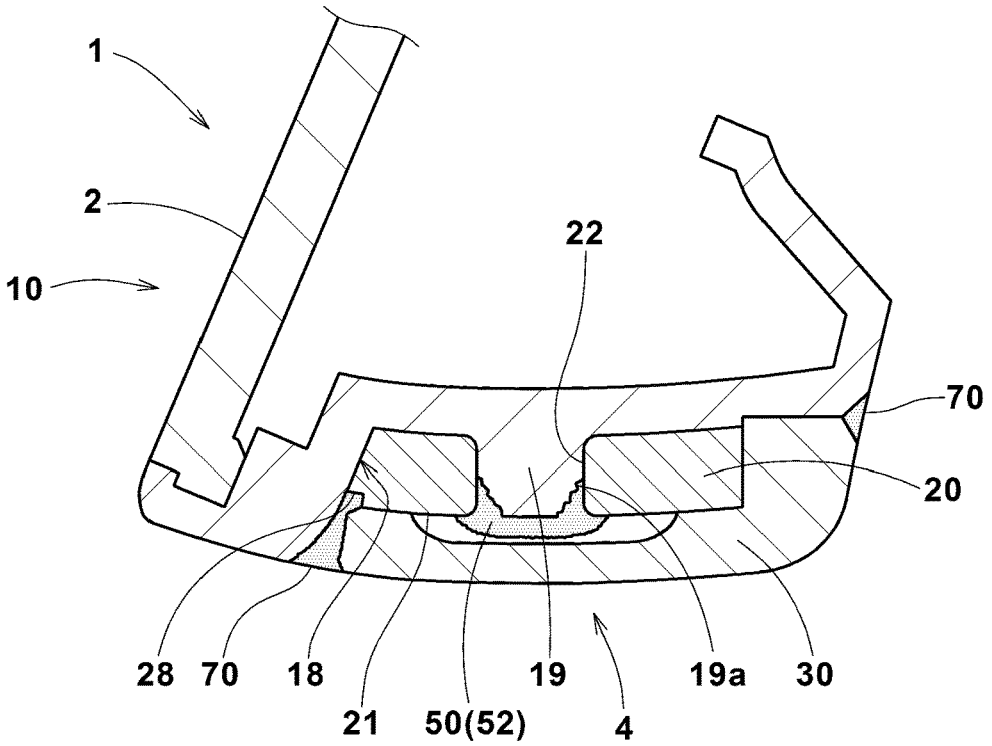
FIG. 10(*b*) is a cross-sectional partial view of a golf club head as still another embodiment of the present invention in which the weight member shown in FIG. 9 is employed, taken along a line corresponding to line B-B of FIG. 2.

In this example, the securing portion 50 can be disposed only between the through hole 22 and the convex portion 19 as shown in FIG. 10(A). But, it is preferable that the securing portion 50 spills out of the gap and a part of the securing portion 50 covers a part of the outer surface 21 of the weight member 20 around the through hole 22 as shown in FIG. 10(B). In either case, it is possible to suppress the vibrations of the weight member 20, but the latter case is preferable.

Figure 11A:
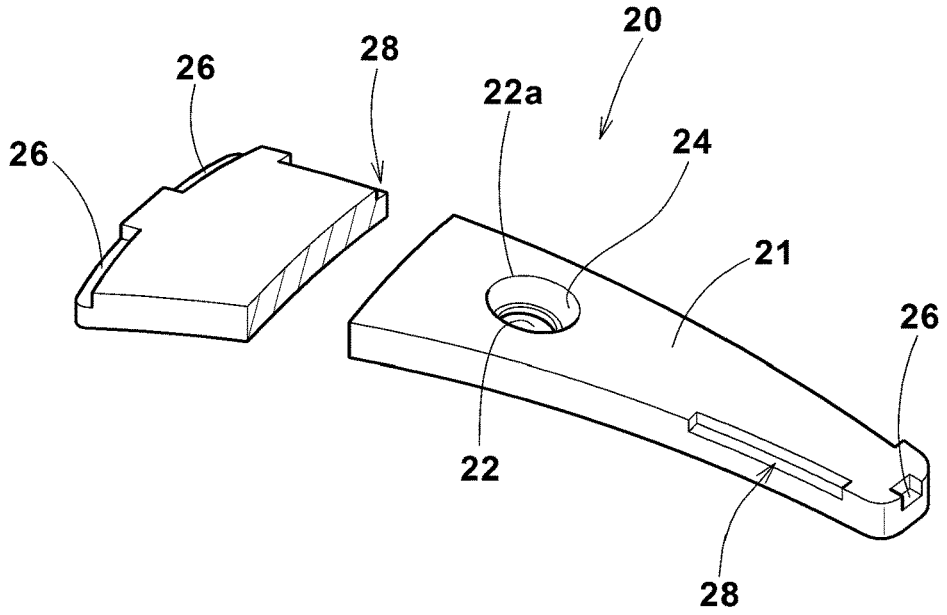
FIGS. 11(A) and 11(B) are perspective views of the weight member shown in FIG. 6.
Figure 11B:
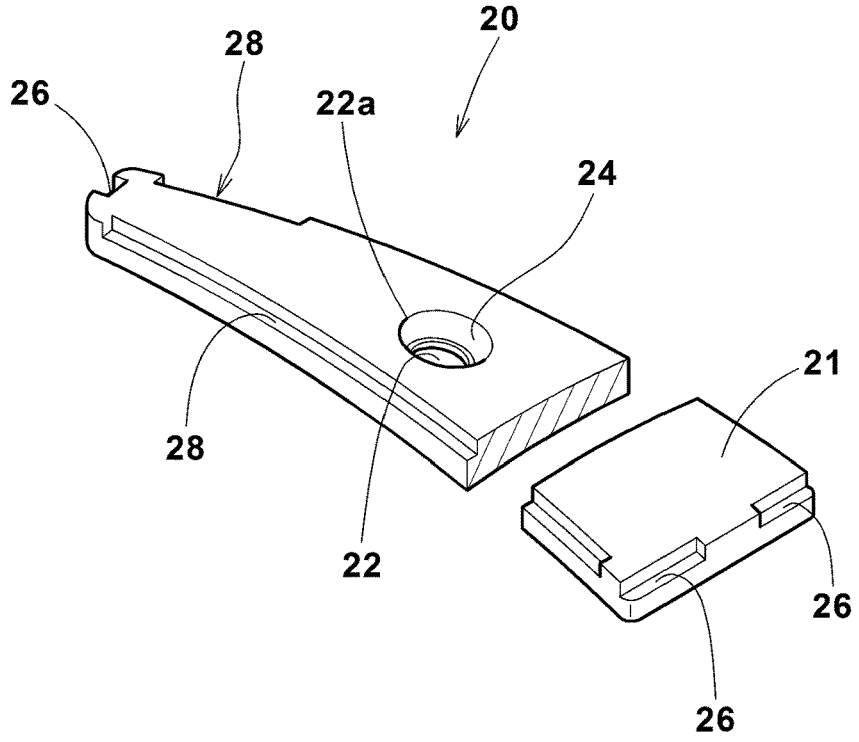

Going back to the configuration of the weight member 20 other than the through hole 22, the edges of the outer surface 21 of the weight member 20 which surface faces toward the outside of the head is preferably provided with first stepped portions 26 and second stepped portions 28 as shown in FIGS. 11(A) and 11(B).

The first and second stepped portions 26 and 28 are each formed by a recessed portion in a stepwise manner.

In this embodiment, the toe-side edge of the outer surface 21 is provided with two first stepped portions 26, the heel-side edge of the outer surface 21 is provided with one first stepped portion 26, the front edge of the outer surface 21 is provided with one second stepped portion 28, and the rear edge of the outer surface 21 is provided with one second stepped portion 28.

when compared with the first stepped portions 26, the second stepped portions 28 extend long in the toe-heel direction.

Figure 12:
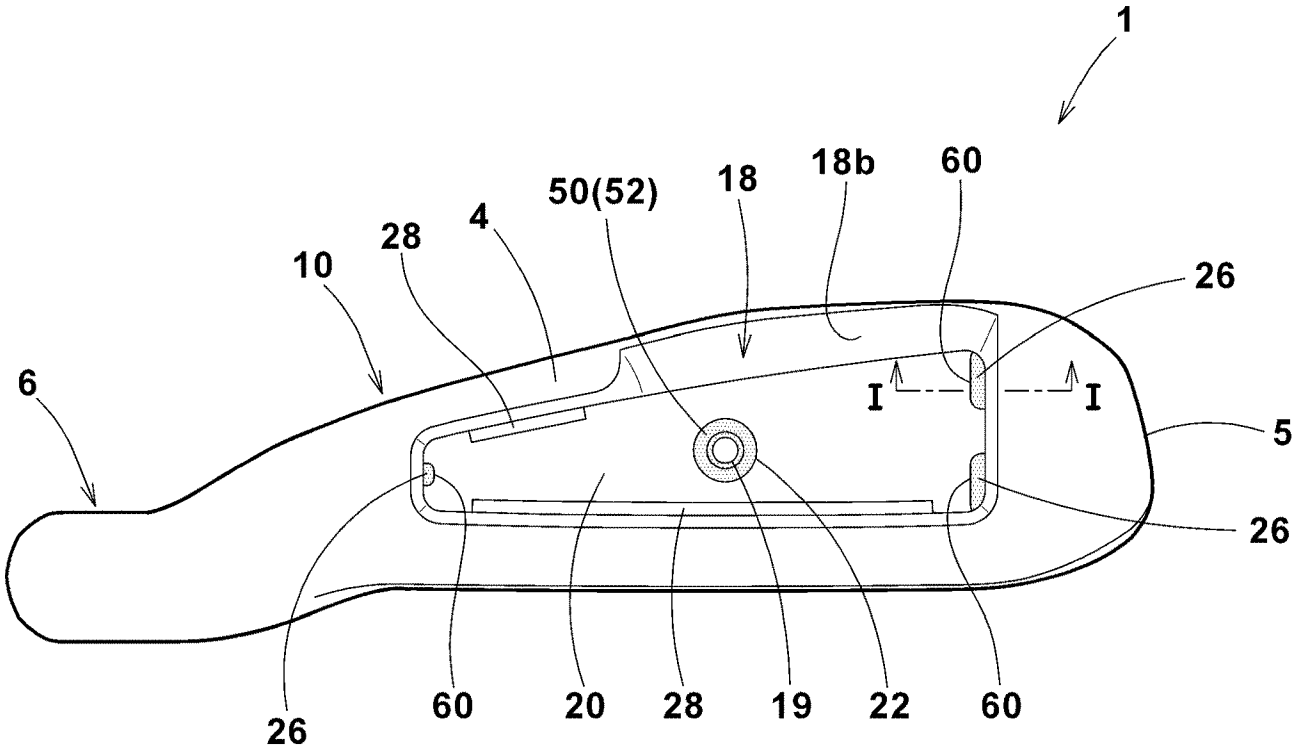
FIG. 12 is a bottom view showing a state in which the weight member shown in FIGS. 11(A) and 11(B) is attached to the head main body.
Figure 13:
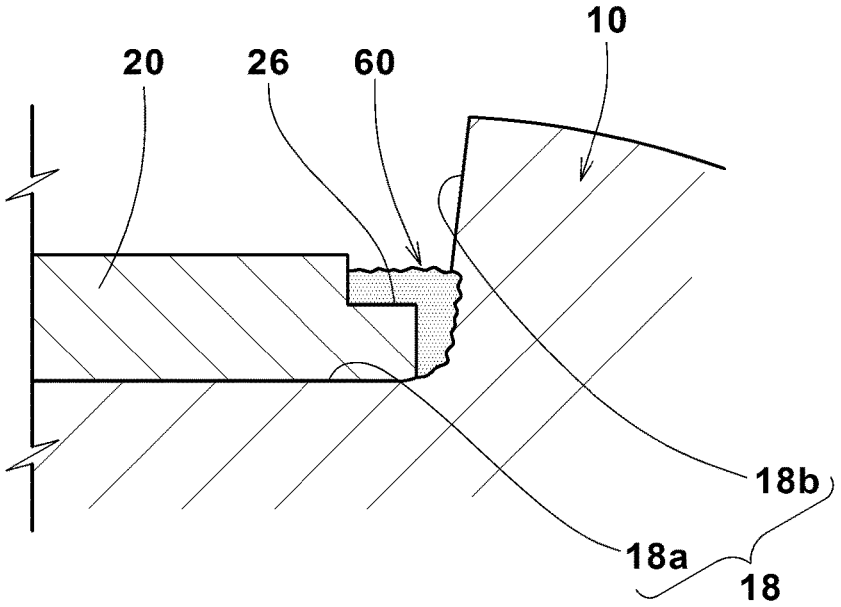
FIG. 13 is a cross-sectional view taken along line I-I of FIG. 12.

FIG. 12 is a bottom view of the head, in which the weight member 20 has been fitted in the recess 18 of the head main body 10, but the fixing member 30 is not yet attached to the head main body 10. FIG. 13 is a cross-sectional view taken along line I-I of FIG. 12.

It is preferable that the first stepped portions 26 of the weight member 20 are covered with the weld bead 60 united with the recess 18 as shown in FIGS. 12 and 13.

The weld bead 60 is made of a solid of molten metal weldable with the head main body 10, and a part of the weld bead 60 is fused and united with the surrounding wall 18*b* of the recess 18. A part of the weld bead 60 fills in the first stepped portion 26 so as to cover the first stepped portion 26. Thereby, the weld bead 60 restrains the weight member 20 from the outer side of the head. Likewise, the first stepped portion 26 provided on the heel-side edge is covered with the weld bead 60 although the detailed description is omitted. In this case, therefore, the vibrations of the weight member 20 occurring on the toe side and heel side can be more effectively suppressed by the weld bead 60 entering in the space of each first stepped portion 26.

The above-mentioned fixing member 30 is fixed to the recess 18 in such a state that the fixing member 30 covers at least a part of the weight member 20 from the outer side of the head as shown in FIGS. 7(A) and 7(B).

The fixing member 30 in this example has an inner surface 32 contacting with at least a part of the outer surface 21 of the weight member 20.

The fixing member 30 in this example is made of a tungsten-nickel-iron alloy comprising w, Ni and Fe and having a specific gravity greater than the head main body 10 similarly to the weight member 20. Thereby, in the golf club head 1 in this embodiment, it is possible to utilize not only the mass of the weight member 20 but also the mass of the fixing member 30 in designing the center of gravity of the golf club head 1 (in this embodiment, in order to lower the position of the center of gravity).

It is preferable that the fixing member 30 has a lower content of w and a higher content of Fe as compared with the weight member 20 in order to make the specific gravity of the fixing member 30 smaller than that of the weight member 20.

In the golf club head 1 in this embodiment, with respect to the specific gravity, the head main body 10 is smallest, the weight member 20 is largest, and the fixing member 30 is between them. Such fixing member 30 has a good weldability to the iron-based alloy of the head main body 10, and can be welded to the head main body 10 (can show strong joint strength in the weld joint), while contributing to the design freedman of the center of gravity of the head.

Preferably, the specific gravity of the fixing member 30 is set in a range from 8.0 to 10.0.

In this embodiment, the fixing member 30 covers the weight member 20 entirely so that the weight member 20 is contained within the recess 18 without being exposed in the outer surface of the head which surface has the finished shape.

The peripheral edge of the fixing member 30 is welded to the head main body 10, and the weld bead 70 is shown in FIGS. 7(A) and 7(B). In order to increase the joint strength, it is preferred that the entire peripheral edge of the fixing member 30 is welded to the head main body 10.

The above-mentioned second stepped portions 28 formed at the edges of the weight member 20 are preferably covered with a part of the weld bead 70 which unites the fixing member 30 with the head main body 10. That is, when welding the fixing member 30 and the head main body 10, a part of the molten metal flows through a gap between the fixing member 30 and the head main body 10 (surrounding wall 18*b* of the recess 18) to fill up the space of the second stepped portion 28, and is solidified covering the second stepped portion 28. Such weld bead 70 more effectively prevents the vibrations of the weight member 20 and can reliably suppress the generation of noise.

In this embodiment, as shown in FIG. 7(A), the second stepped portions 28 on both the front side and the back side of the weight member 20 are covered with the weld bead 70, therefore, the generation of noise can be more reliably suppressed.

While description has been made mainly of the structure of the golf club head 1 according to the present invention, such golf club head 1 can be manufactured through a method which comprises:

a) a step of preparing each of the head main body 10, the weight member 20 and the fixing member 30, b) a step of filling up the gap between the convex portion 19 and the through hole 22 with the molten metal and solidifying the molten metal after the head main body 10 and the weight member 20 have been arranged so that the convex portion 19 of the head main body 10 is positioned in the through hole 22 of the weight member 20, and c) a step of welding the fixing member to the head main body in such a state that the fixing member covers at least a part of the weight member 20 from the outer side of the head.

Further, the manufacturing method may additionally comprise at least one of the following steps of:

d) filling up the molten metal on the first stepped portion 26 of the weight member 20, prior to the step (c) and fixing the molten metal to the head main body 10 (e.g., the surrounding wall 18*b* of the recess 18); and e) pouring the molten metal through the gap between the fixing member 30 and the head main body 10, onto the second stepped portions 28 of the internally-located weight member 20 in the step (c), and solidifying the molten metal.

FIG. 14 shows another embodiment of the present invention. In the following description of this embodiment, the same or common elements as in the previous embodiments are denoted by the same reference numbers, and the detailed descriptions thereof are omitted.

In the embodiment shown in FIG. 14, the fixing member 30 is provided with a through hole 34.

The above-mentioned securing portion 50 of the weld bead 52 which is disposed between the through hole 22 of the convex portion 19 and the weight member 20, is also disposed in the through hole 34.

The weld bead 52 is made of a material being weldable with the convex portion 19 as well as the fixing member 30.

In this embodiment, the fixing member 30 is welded and fixed to the head main body 10 (more specifically the convex portion 19), at the peripheral edge portion as well as at the central portion, therefore, the vibrations of the fixing member 30 for fixing the weight member 20 is suppressed, and it is possible to more reliably suppress the vibrations of the weight member 20.

While detailed description has been made of preferable embodiments of the present invention, the present invention can be embodied in various forms without being limited to the illustrated embodiments. Needless to say, characteristic portions of the respective embodiments can be exchanged between the embodiments. Further, a portion of an embodiment can be replaced by a portion of another embodiment.

DESCRIPTION OF THE REFERENCE SIGNS

1 golf club head
10 head main body
18 recess
19 convex portion
19*a* tapered portion of convex portion
20 weight member
21 surface of weight member facing toward outer side of head
22 through hole
22*a* inside opening
22*b* outside opening
24 tapered portion of through hole
26 first stepped portion
28 second stepped portion
30 fixing member
50 securing portion
52 weld bead
60 weld bead
70 weld bead

The invention claimed is:

1. A golf club head comprising:

a head main body provided with a convex portion protruding toward an outside of the head, a weight member provided with a through hole, and disposed outside the head main body so that the convex portion is positioned in the through hole, wherein the through hole has an inside opening and an outside opening on an inner side of the head and on the outer side of the head, respectively, and wherein a cross-sectional area of the through hole is larger at the outside opening than at the inside opening, and a fixing member welded to the head main body in a state in which the fixing member covers at least a part of the weight member from an outer side of the head, wherein a securing portion for fixing the weight member to the head main body is formed between the through hole and the convex portion, and wherein the securing portion is a weld bead united with the convex portion.

2. The golf club head according to claim 1, wherein the convex portion is provided with a tip end side having a tapered part.

3. The golf club head according to claim 1, wherein the through hole is formed in a central portion in a longitudinal direction of the weight member.

4. The golf club head according to claim 1, wherein a specific gravity of the weight member is greater than a specific gravity of the fixing member which is greater than a specific gravity of the head main body.

5. The golf club head according to claim 1, wherein weldability of a material forming the head main body to a material forming the fixing member is higher than weldability of the material forming the head main body to a material forming the weight member.

6. The golf club head according to claim 1, wherein the head main body is provided with a recess, which is recessed from an outer surface of the head having a finished shape, and in which the weight member is disposed.

7. A golf club head comprising:

a head main body provided with a convex portion protruding toward an outside of the head, a weight member provided with a through hole, and disposed outside the head main body so that the convex portion is positioned in the through hole, wherein the through hole has an inside opening and an outside opening on an inner side of the head and on the outer side of the head, respectively, and the through hole has a tapered portion whose cross-sectional area is gradually decreased from the outside opening toward the head main body, and a fixing member welded to the head main body in a state in which the fixing member covers at least a part of the weight member from an outer side of the head, wherein a securing portion for fixing the weight member to the head main body is formed between the through hole and the convex portion, wherein the securing portion is a weld bead united with the convex portion.

8. A golf club head comprising:

a head main body provided with a convex portion protruding toward an outside of the head, a weight member provided with a through hole, and disposed outside the head main body so that the convex portion is positioned in the through hole, and a fixing member welded to the head main body in a state in which the fixing member covers at least a part of the weight member from an outer side of the head, wherein a securing portion for fixing the weight member to the head main body is formed between the through hole and the convex portion, wherein the head main body is provided with a recess, which is recessed from an outer surface of the head having a finished shape, and in which the weight member is disposed, and wherein the weight member is disposed in the recess without being exposed in the outer surface of the head which surface has the finished shape, a surface of the weight member facing toward the outside of the head is provided with an edge portion having a first stepped portion, and the first stepped portion is covered with a weld bead united with the convex portion.

9. The golf club head according to claim 8, wherein said surface of the weight member facing toward the outside of the head is provided with an edge portion having a second stepped portion, and the second stepped portion is covered with a part of a weld bead which welds the head main body and the fixing member together.

10. A golf club head comprising:

a head main body provided with a convex portion protruding toward an outside of the head, a weight member provided with a through hole, and disposed outside the head main body so that the convex portion is positioned in the through hole, and a fixing member welded to the head main body in a state in which the fixing member covers at least a part of the weight member from an outer side of the head, wherein a securing portion for fixing the weight member to the head main body is formed between the through hole and the convex portion, wherein the head main body is provided with a recess, which is recessed from an outer surface of the head having a finished shape, and in which the weight member is disposed, and wherein the weight member is disposed in the recess without being exposed in the outer surface of the head which surface has the finished shape, a surface of the weight member facing toward the outside of the head is provided with an edge portion having a stepped portion, and the stepped portion is covered with a part of a weld bead which welds the head main body and the fixing member together.

* * * * *